US006474402B1

(12) United States Patent
Sauer et al.

(10) Patent No.: US 6,474,402 B1
(45) Date of Patent: Nov. 5, 2002

(54) SEGMENTED ROLL FOR CASTING METAL STRIP

(75) Inventors: James R. Sauer, Hamilton; Ronald J. O'Malley, Miamisburg; Robert S. Williams, Fairfield, all of OH (US)

(73) Assignee: Armco Inc., Middletown, OH (US)

( * ) Notice: Subject to any disclaimer, the term of this patent is extended or adjusted under 35 U.S.C. 154(b) by 0 days.

(21) Appl. No.: 09/348,123

(22) Filed: Jul. 2, 1999

(51) Int. Cl.[7] ..... B22D 11/06; F28F 5/02

(52) U.S. Cl. ..... 164/428; 164/443; 492/40; 492/46

(58) Field of Search ..... 164/429, 428, 164/479, 480, 443; 492/40, 46

(56) References Cited

U.S. PATENT DOCUMENTS

| | | | | | |
|---|---|---|---|---|---|
| 3,336,866 | A | * | 8/1967 | Hawthorne | 101/348 |
| 4,993,478 | A | * | 2/1991 | George, II | 164/479 |
| 5,207,265 | A | * | 5/1993 | Hasegawa | 164/428 |
| 5,228,497 | A | * | 7/1993 | Romanowski | 164/480 |
| 5,469,909 | A | * | 11/1995 | Sasaki et al. | 164/428 |
| 5,787,967 | A | * | 8/1998 | Vendeville et al. | 164/452 |
| 5,885,544 | A | | 3/1999 | Ishikawa | 164/428 |
| 5,887,644 | A | * | 3/1999 | Akiyoshi et al. | 164/428 |

FOREIGN PATENT DOCUMENTS

| | | | |
|---|---|---|---|
| WO | 52706 | 12/1998 | B22D/11/06 |

* cited by examiner

*Primary Examiner*—M. Alexandra Elve
*Assistant Examiner*—Len Tran
(74) *Attorney, Agent, or Firm*—Larry A. Fillnow

(57) ABSTRACT

Casting molten metal using a segmented roll for casting continuous metal strip. A strip caster (10) for producing a continuous strip (18) includes a tundish for containing a melt and a pair of horizontally disposed water cooled composite casting rolls (84). The casting rolls are juxtaposed relative to one another for forming a pouring basin (16) for receiving molten metal. The composite rolls are formed from a plurality of annular segments (45). Each segment preferably includes at least a pair of coolant openings (34) and means for aligning the coolant openings, such as a pair of alignment openings (26). The segments are axially aligned and structurally connected by a pair of connecting rods (42) extending completely across the width of the roll through the alignment openings and through appropriate end plates (96). Each roll includes a load supporting spindle (86) with each end of the roll sealed by a rotary seal (88). Coolant water is supplied to the composite casting roll by a flexible conduit (90) and heated water is removed through a flexible conduit (92).

24 Claims, 14 Drawing Sheets

SEGMENTED ROLL FOR CASTING METAL STRIP

BACKGROUND OF THE INVENTION

This invention relates to casting continuous metal strip using a segmented roll. More particularly, the invention relates using a casting roll formed from an assembly of similar annular segments having a common diameter. The segmented roll lowers the cost of producing a casting roll and allows for larger width rolls to be manufactured. The segmented casting roll may also enhance solidification of the melt to the roll outer chill surface and minimize defects on the chill surface during casting of metal strip.

Direct strip casting involves bringing a melt into contact with a liquid cooled substrate such as the chill surface of a metal casting roll, e.g., copper. This may be accomplished by casting the melt onto a single casting roll rotating past a refractory pouring nozzle or by pouring the melt into the meniscus formed between a pair of opposing rotating casting rolls, i.e., twin rolls. Intimate contact of solidifying metal to a bare metal substrate is required to achieve a high cooling rate. The casting roll includes channels, through which a cooling liquid such as water or gas is circulated, extending through the entire width of the roll. This cooling liquid carries away heat absorbed from the molten metal introduced into the interior of the roll. As the solidified metal strip cools while still in contact with the chill surface of the casting roll, the strip contracts. This contraction results in very high tensile stresses due to constraint from the chill surface. The solidification rate of the strip is determined by the heat transfer rate. Accordingly, cooling of the casting roll is of critical importance to successfully casting metal strip.

Casting rolls are one or two-piece and manufactured by machining an ingot into its final form. By its very nature, this roll manufacturing process is time consuming and expensive. The diameter and width of the rolls that can be produced are limited to the size of the ingot that can be cast. Furthermore, the machining operations that can be performed on this casting restrict what can be done in terms of consistency and shape. For example, openings and cooling channels within the roll must be straight. Any texturing of the outer chill surface of the roll must be done using a large lathe or patterned into the chill surface using an abrasive disk, grit blasting, or texturing by rolling, chemical etching or laser cutting. These mechanisms all limit the textures and patterns available for the outer surface of a strip casting roll. While the width of the roll limits the width of a metal strip that can be produced, the surface texture, roll diameter, and cooling channel shape, location and consistency all limit the thermal properties of the roll. The ability to cast certain compositions of metal is directly related to the heat transfer properties of the casting roll. Straight bored channels must maintain a constant distance from the roll surface, severely limiting the ability to control heat transfer, and therefore, product quality near the ends of the casting roll, i.e., edge of cast strip. Furthermore, straight bored channels can create certain structural integrity problems within a twin roll casting system that employs roll force to the solidifying metal pool.

It is known to provide a one-piece casting roll including longitudinally extending coolant passages machined through the entire width of the inner body of the roll. It also is known to provide a two-piece casting roll including longitudinally extending coolant passages machined into the inner surface of a sleeve mounted over the casting roll. U.S. Pat. No. 5,887,644 discloses a copper sleeve mounted to cover a stainless steel roll body. Longitudinally extending coolant passages are defined by the interior space between the inner roll body and the outer sleeve.

Nevertheless, there remains a need for a strip casting roll that is less costly to manufacture. There also remains a need for a strip casting roll that is available in a greater variety of widths and diameters. Additional needs include a strip casting roll available in a greater variety of chill surface textures and having improved heat transfer characteristics, improved maintainability and longevity of the moderated heat transfer texture, and reduced cost casting roll repairs.

BRIEF SUMMARY OF THE INVENTION

A principal object of the invention is to produce a strip casting roll having any predetermined width and diameter.

Another object of the invention is to reduce the manufacturing cost for producing a strip casting roll having any predetermined width and diameter.

Another object of the invention is to increase the control and uniformity of the heat transfer rate across the width of the chill surface of a strip casting roll and thereby control the thickness profile across the width of an as-cast metal strip.

Another object of the invention is to control the edge cooling effect of a strip casting roll.

Another object of the invention is to make the heat transfer rate across the width of a strip casting roll more uniform.

Another object of the invention is to provide for asymmetric thermal and electrical conductivity of a strip casting roll in order to enhance thermal uniformity.

Another object of the invention is that it broadens the ability to use various materials and combinations of materials in the construction of a casting roll.

Another object of the invention is to improve use of electromagnetic devices, such as are used for molten metal edge containment.

Another object of the invention is the development of a casting roll with better structural integrity for twin roll casters using roll force solidification.

The invention relates to a segmented roll for casting molten metal into a continuous strip. The invention includes a casting roll assembled from a plurality of annular segments having a common diameter. Each segment includes an axially extending opening for cooling the roll with the opening positioned near an outer chill surface of the segment. The segments are axially aligned and structurally connected so that the openings form a cooling channel extending across the width of the roll for circulating a cooling fluid to extract heat from the chill surface of the casting roll.

Another feature of the invention is for each aforesaid segment to include a plurality of cooling openings.

Another feature of the invention is for the aforesaid plurality of cooling openings of each segment to be evenly spaced and forming an annular array around each segment.

Another feature of the invention is for the aforesaid roll including means for aligning adjacent segments.

Another feature of the invention is for the aforesaid alignment means to include at least one axially extending opening positioned a distance inside the array and an alignment mechanism extending through each of the alignment openings.

Another feature of the invention is for the aforesaid segments having textured outer surfaces.

Another feature of the invention is for adjacent ones of the aforesaid segments having different textured outer surfaces.

Another feature of the invention is for adjacent ones of the aforesaid segments being formed of different materials.

Another feature of the invention is for adjacent ones of the aforesaid segments having different axial thicknesses.

Another feature of the invention is for both planar surfaces of the aforesaid segments to include an insulative coating.

Another feature of the invention is for the aforesaid segments being slightly rotated relative to each other to form spiral cooling channels extending through the roll.

Another feature of the invention is for the aforesaid segments being metal.

An advantage of the invention includes a major cost savings to produce a strip casting roll having any predetermined width and diameter from a plurality of small annular metal segments having a common diameter rather than from a one-piece machined large cast section.

Another advantage of the invention includes flexibility in the internal geometric design of coolant channels thereby allowing differential cooling across the width of a strip casting roll.

Another advantage of the invention includes flexibility in the external design of the chill surface of a strip casting roll by having multiple textures and/or coatings across the width of the roll.

Another advantage of this invention is being able to form a metal casting roll that resists current flow therethrough thereby enhancing the use of an electromagnetic device for inducing magnetic force into the molten metal during casting.

Another advantage of the invention is that it may increase the uniformity of heat transfer, allowing improved surface quality of cast metal strip, improved strip thickness uniformity and less surface wear to the casting roll.

Another advantage includes cost savings resulting from being able to use smaller manufacturing equipment, higher production speeds, and less scrap when manufacturing the casting roll.

Another advantage of the invention is the possible use of a clamping mechanism to hold the segments in place resulting in less distortion of the casting roll due to thermal expansion characteristics. This also would allow removing damaged segments as well as the ability to change cast width diameter without having to maintain a large inventory of casting roll sizes.

The above and other objects, features and advantages of the invention will become apparent upon consideration of the detailed description and appended drawings.

DETAILED DESCRIPTION OF THE PREFERRED EMBODIMENT

Figure 1:
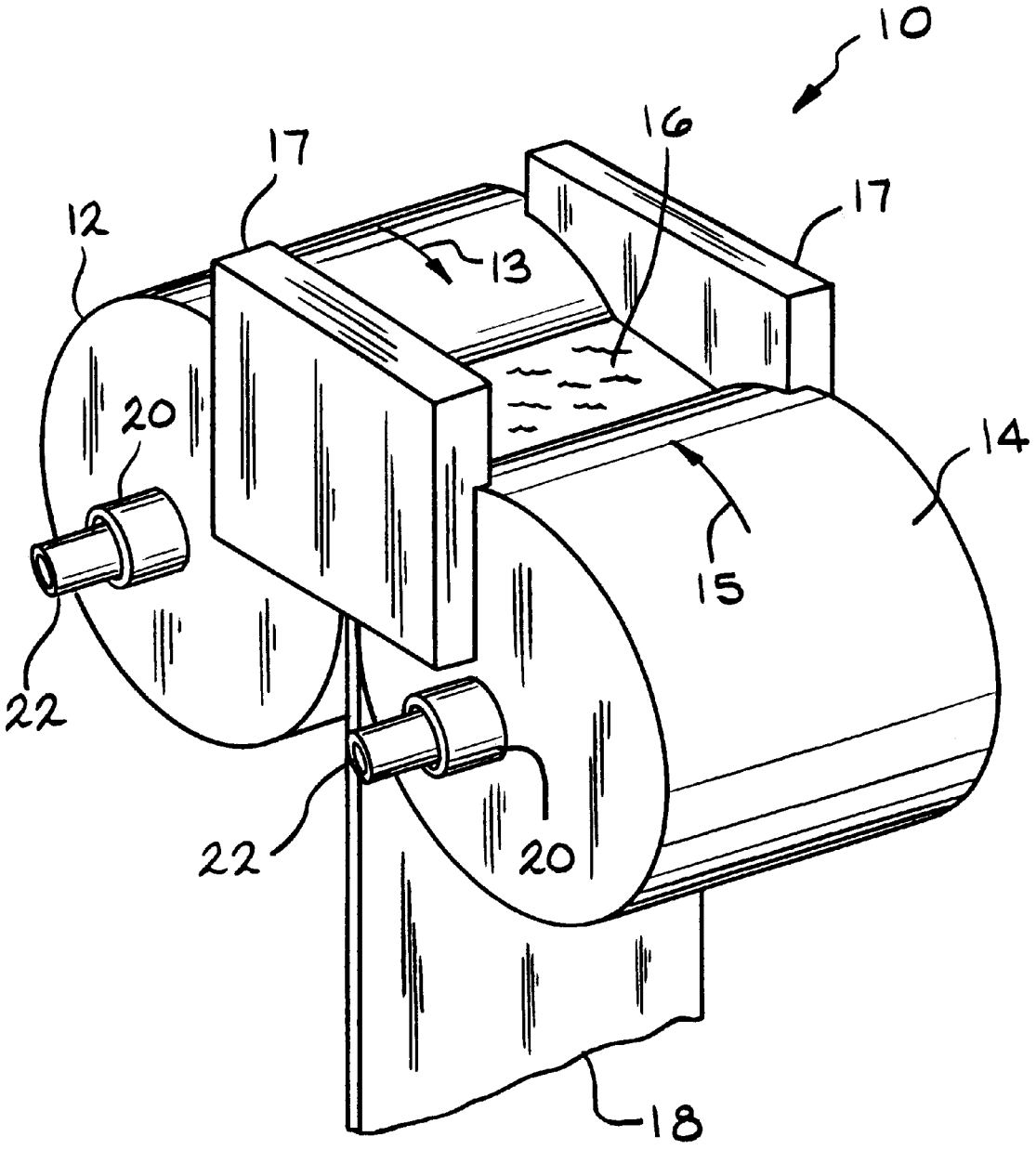
FIG. 1 (PRIOR ART)
FIG. 1 is a perspective view of a conventional twin roll strip caster.

This invention relates to continuously casting molten metal using a segmented roll for forming metal strip. The casting roll is formed from a plurality of axially aligned annular segments assembled into a roll for use in continuous casting. By segments, it will be understood to include, but not be limited to, pieces having a common diameter, i.e., the same diameter, that are stamped, punched, cut, severed, and the like from sheets, continuous strip, plates, continuous plate, board, blanket, and cast forms of metal or other materials. These segments may be formed from materials as thin as 1.5 mm or less or be formed from thicker materials as thick as 15 mm or more. The base composition of these segments may be heat resisting metals such as copper, alloy steel, austenitic steel, aluminum, bronze, nickel or other non-metallic materials such as boron nitride, graphite, zirconia, alumina, other refractory or other suitable heat resisting materials. Furthermore, any of these segments may be coated or plated with any of the base composition materials listed herein.

As will become apparent from the discussion herein, advantages for forming a casting roll from individual segments allows for the cross-sectional geometry of coolant channels to be of any two dimensional shape. Any coolant channel shape that can be "stamped" or cut into the form of an opening through the segment can be produced. The shape of these coolant openings may be circular, polygonal, oval, and the like. Furthermore, this allows the channels to accurately be positioned with respect to the outer chill surface of a casting roll. By progressively moving the cooling opening location, dimension and/or shape for each adjacent segment, the cooling channel location, dimension and/or shape extending through the casting roll can be altered so that allowances can be made for any required differences in cooling rates, i.e., differential temperature, associated with the casting roll.

The stamping of segments also advantageously allows for an unlimited roll width. Any width, e.g., 200 cm or more, is possible by merely adding additional segments until a predetermined width is obtained. Roll diameter is limited only by the width of sheet, strip or plate available, which is much larger than the width of the largest prior art casting available. Any axial thickness of segments up to 15 mm or more can be used to make a casting roll. The axial thickness of the segments for each casting roll may vary as well. For example, it may be desirable to change the thickness of alternating segments. These may be different in order to facilitate assembly, manufacturing, maintainability, or to facilitate width changes. Furthermore, the segments may be alternated or changed in axial thickness to control uniformity of heat transfer across the strip and to improve control of the sheet thickness profile.

In addition to casting roll size and cooling channel flexibility, i.e., shape, depth, pattern, variations of material across the width of the casting roll, the segmented casting roll of this invention also is less expensive to manufacture. The roll would be manufactured using much smaller production equipment and any errors in manufacturing would result in less scrap. Although they may be solid, the segments preferably have a large central opening, thereby reducing the overall weight of the casting roll.

It also is possible to provide treatments to the outer chill surface of the roll segments. For example, it is possible to provide a nickel or nickel alloy coating, e.g., electroplating, flame spraying, for improving thermal conductivity. It also is possible to chemically or mechanically provide various textured surfaces to the segments so as to improve strip removal characteristics of the as-cast strip from the chill surface and heat transfer characteristics of the casting roll. By "roughening" the chill surface of the segments, the fraction of the chill casting surface in contact with the as-cast strip is reduced. A major advantage of this invention not otherwise practical is being able to alternatively stack segments having different chill surface heat transfer characteristics thereby obviating the need to apply a thermal moderator and wear resisting coating.

Another possible advantage of this invention is being able to form segments from sheet, strip or plate coated on both planar surfaces with coatings having special characteristics. The coating forms a barrier between adjacent segments when the segments are assembled together into the casting roll. For example, the coating could be a non-metallic coating such as alumina, zirconia, titania, chrome, boron nitride, graphite, titanium, carbide, silica, magnesia and the like. These coatings can be applied for the purpose of moderating electrical conductivity, thermal conductivity, roll surface dressing, surface wear resistance, strip adhesion, segment separation for repair, any combination of the above.

An electromagnetic device may be used to inject or induce a magnetic force into the molten metal during casting. These non-metallic coatings can be used for their insulating characteristics to enhance the electromagnetic device by minimizing current flow through the casting rolls. Examples of these insulating coatings include zirconia, alumina, boron nitride, silica, silicates and magnesia.

This invention relates to casting molten metal using a segmented roll for casting a continuous metal strip. Strip casting involves bringing a melt into contact with a water cooled chill surface of a casting roll. This may be accomplished by rotating the roll past a refractory pouring nozzle or by pouring the melt into the meniscus formed between a pair of opposing rotating casting rolls. Intimate contact of solidifying metal to a bare substrate is required to achieve a high cooling rate. If adhesion of the strip to the chill surface is too high, the strip may crack. If the adhesion is too low, the strip can lift-off from the chill surface causing a decrease in the heat transfer rate.

The segmented casting roll of this invention may be used to form metal strip from a variety of ferrous and non-ferrous molten metals such as stainless steel, electrical steel, alloy steel, low carbon steel, aluminum and aluminum alloys, titanium and titanium alloys, copper and copper alloys and amorphous metals. In the case of steels, the segmented casting roll of this invention having more uniform heat extraction rates is very important because of the effects of thermal conductivity on hot strength of the as-cast solidified strip.

Referring to FIG. 1, reference numeral 10 denotes a prior art twin roll strip caster for producing a continuous metal strip 18. Caster 10 includes a tundish (not shown) for containing molten metal, a pair of horizontally disposed water cooled casting rolls 12 and 14 and a motor (not shown) for rotating rolls 12 and 14 toward one another as indicated by arrows 13 and 15 respectively. Casting rolls 12, 14 are juxtaposed relative to one another for forming a pouring basin 16 including a pair of spaced side dams 17 for containing the molten metal. Casting rolls 12, 14 are cooled, e.g., water, gas, and are fabricated from a highly thermally conductive metal such as copper or austenitic steel. To enhance heat and wear resistance of the casting roll, the outer or chill surface of the roll normally is coated with an oxide resistant metal such as nickel or nickel alloy. As the molten metal is withdrawn from between rolls 12, 14, solidified strip 18 is formed. Each casting roll 12 and 14 includes a spindle 20 including a hollow tubing member 22 for circulating roll coolant through the roll.

The type strip caster illustrated in FIG. 1 is commonly referred to a twin roll or dual drum caster. The casting roll of the invention can be used with a twin roll caster of the type illustrated in FIG. 1 or with a single roll caster as well. Unlike the twin roll caster of FIG. 1 wherein the strip is withdrawn from below an opposing pair of rolls, a strip is formed by being pulled over the top of one casting roll in a single roll caster.

Figure 2:
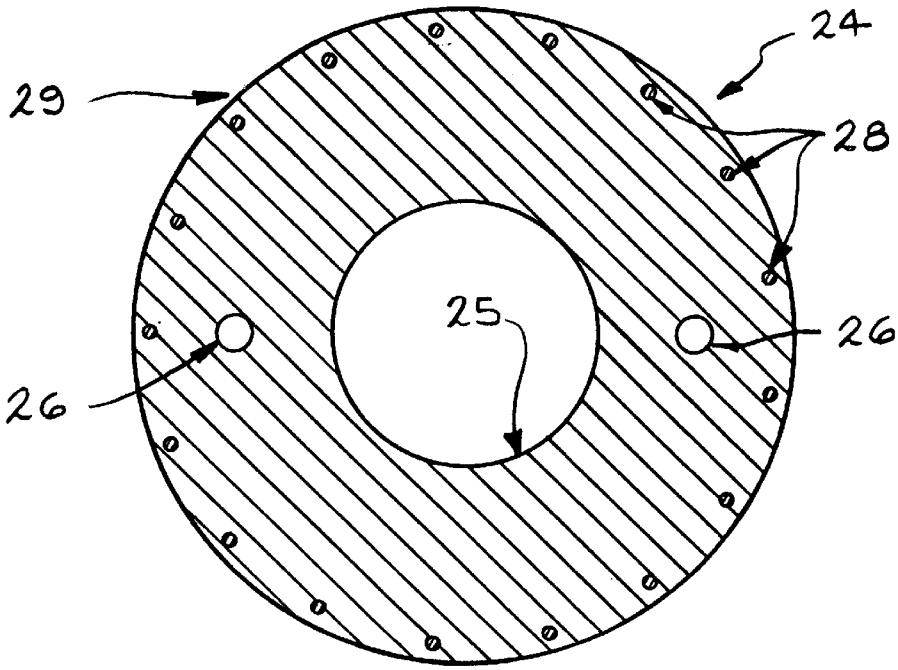
FIG. 2 is a cross-sectional view of a segment used to make a composite casting roll of this invention.
Figure 3:
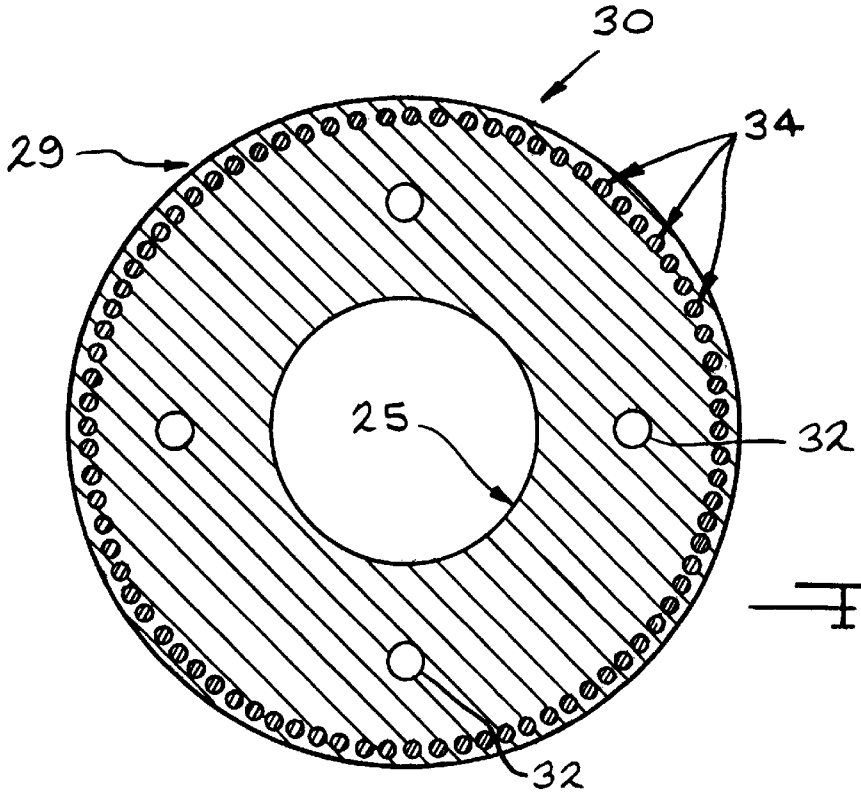
FIG. 3 is a cross-sectional view of another embodiment of a segment of this invention.

FIG. 2 illustrates one embodiment of an annular segment 24 having an inside or central opening 25 used for forming a segmented roll of the invention for casting continuous metal strip. Segment 24 may be stamped, punched, cut or otherwise severed from sheet, continuous strip, plate and the like having thicknesses up to 15 mm or more. Segment 24 preferably includes an annular array of coolant openings 28 (seventeen illustrated in FIG. 2) extending through the axial thickness and evenly spaced around segment 24. The array of coolant openings 28 for extracting heat are positioned near an outer chill surface 29 of segment 24. By near the chill surface is meant a distance beneath the chill surface of the roll that is bound by its ability to have a cooling effect on the chill surface at the extreme furthest from the chill surface and bound by structural soundness due to roll force, coolant pressures, and materials of construction at the near surface extreme. Optimal depth will depend on coolant type, coolant flow rates, coolant channel size and shape, coolant pressure, roll force, and materials of construction for the casting roll segments. For casting rolls having diameters of 1000 mm or more, the array of coolant openings for extracting heat may be positioned at a depth of as little as 5 mm, preferably at least 10 mm and more preferably at least 12 mm from the outer chill surface. Means for aligning the segments of the casting roll of the invention may include an alignment mechanism such as a rod, a keyway, indents, and the like. In a preferred embodiment, the alignment means includes two alignment openings 26 positioned a distance inside the annular array of coolant openings 28 for receiving an alignment rod. That is, the alignment openings preferably are positioned a greater distance from the outer chill surface than are the coolant openings. The alignment openings may be positioned a distance of 20 mm or more from the outer chill surface FIG. 3 illustrates another embodiment of an annular segment 30 having central opening 25 used for forming a segmented roll of the invention for casting continuous metal strip. Segment 30 includes an annular array of numerous coolant openings 34 evenly spaced around segment 30. Array of coolant openings 34 is positioned near outer chill surface 29. Four alignment openings 32 are shown evenly spaced and positioned a distance within the array of coolant openings 34.

Figure 4:
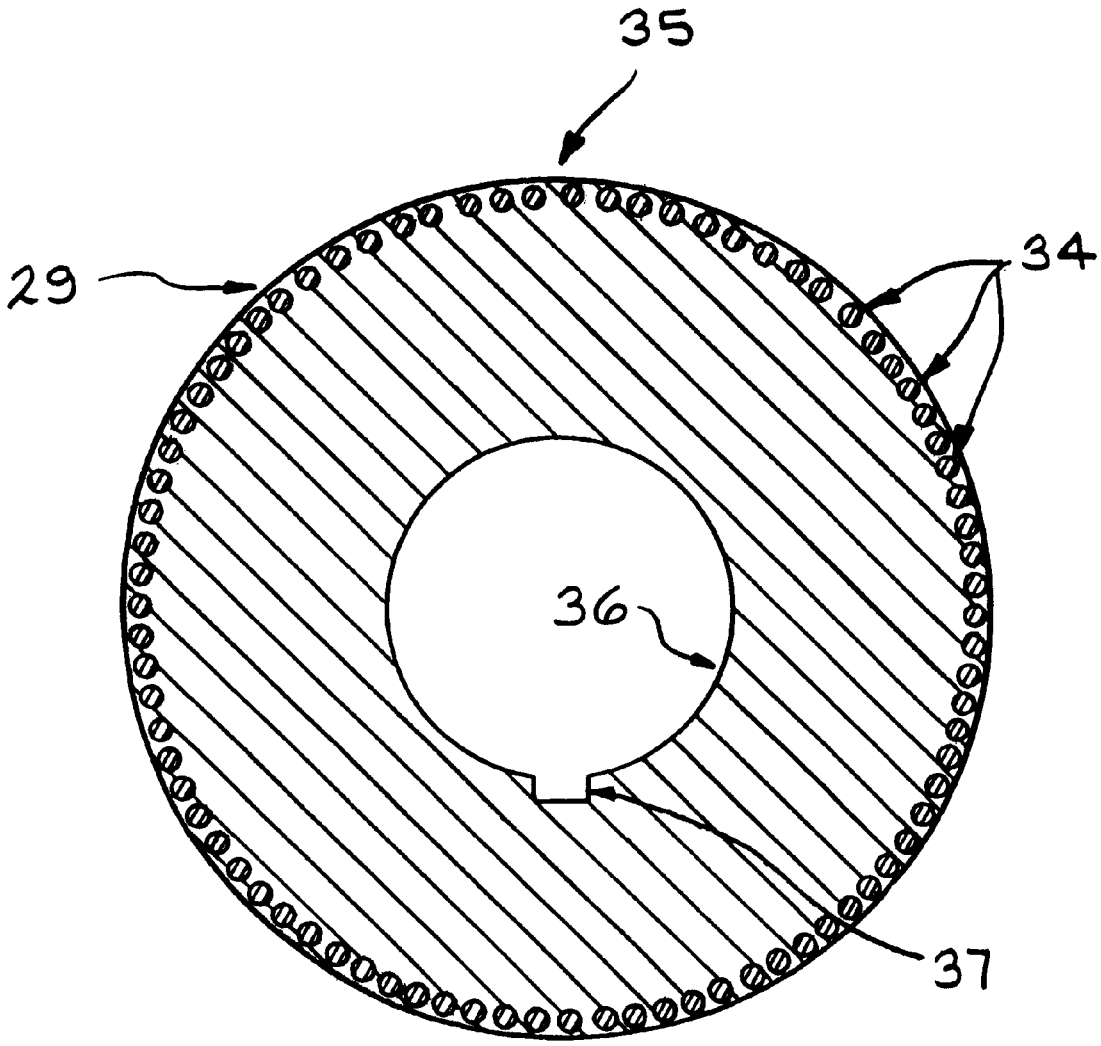
FIG. 4 is a cross-sectional view of yet another embodiment of a segment of this invention.

FIG. 4 illustrates another embodiment of an annular segment 35 having a central opening 36 and an alignment keyway 37 used for forming a segmented roll of the invention for casting continuous metal strip. Segment 35 includes an annular array of numerous coolant openings 34 evenly spaced around segment 35. The array of coolant openings 34 is positioned near outer chill surface 29. One alignment keyway 37 is shown positioned Within central opening 36.

Figure 5:
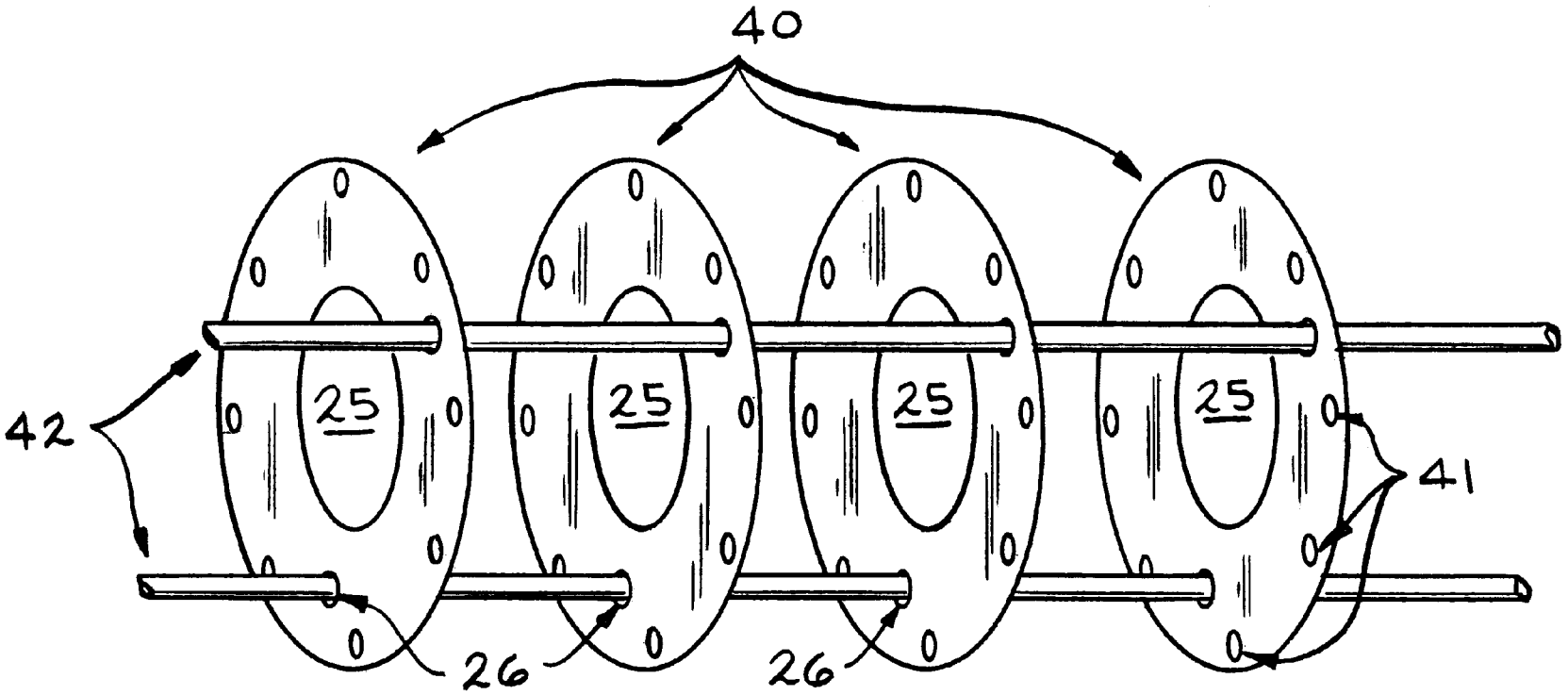
FIG. 5 illustrates a schematic of an assembly of a plurality of another embodiment of segments being axially aligned using a pair of alignment rods.

FIG. 5 illustrates a schematic of how a composite casting roll can be formed from a plurality of segments similar to those illustrated in FIG. 2 or 3. A plurality of segments 40 are axially aligned by aligning openings 26 using an alignment rod 42 to assure proper alignment of central opening 25 and eight coolant openings 41 such that the coolant openings will form coolants channel through the full width of the roll.

A composite casting roll of the invention may be formed from a plurality of annular segments with the segments structurally connected together such as by using aligned connected alignment openings 26 and passing alignment rod 42 through each of the aligned openings. Alternatively, the segments may be structurally connected together by welding of adjacent segments to one another, soldering adjacent segments to one another, hot isostatic pressing (HIP) bonding the segments together or physically clamping the segments together by spring loading, hydraulic loading or other clamping means.

Figure 6:
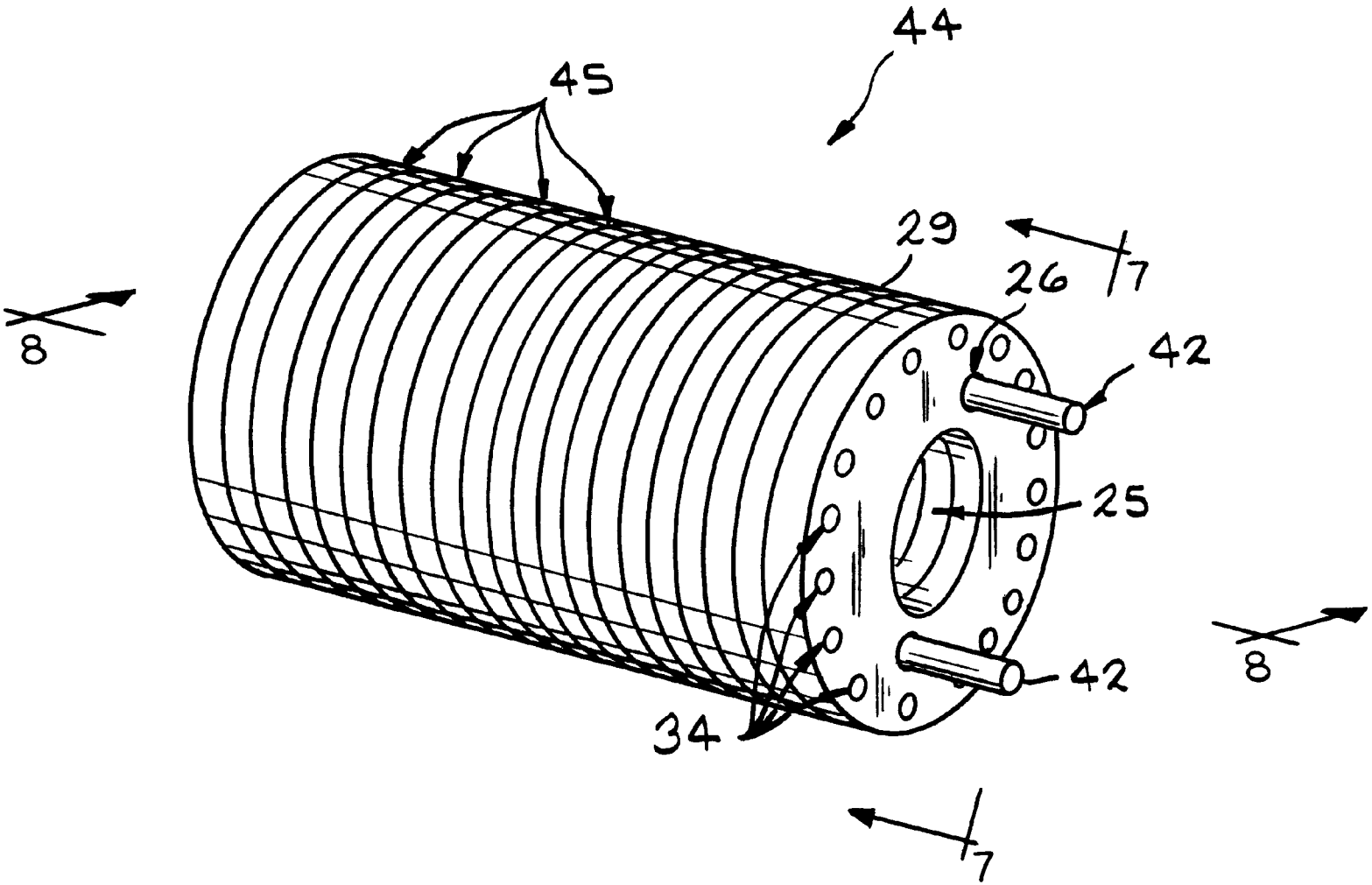
FIG. 6 is a perspective view of one embodiment of a composite casting roll of the invention formed from a plurality of segments similar to those illustrated in FIGS. 2 and 5.

FIG. 6 illustrates a preferred embodiment of a partially assembled composite casting roll 44 of the invention formed using segments 45 having axially aligned cooling openings 34 (seventeen shown in FIG. 6). If the segments are HIP fused together, a wear resistant coating or a coating of lower thermal conductivity to moderate heat transfer may be applied to the outer chill surface of the segments as part of the fusion process.

Figure 7:
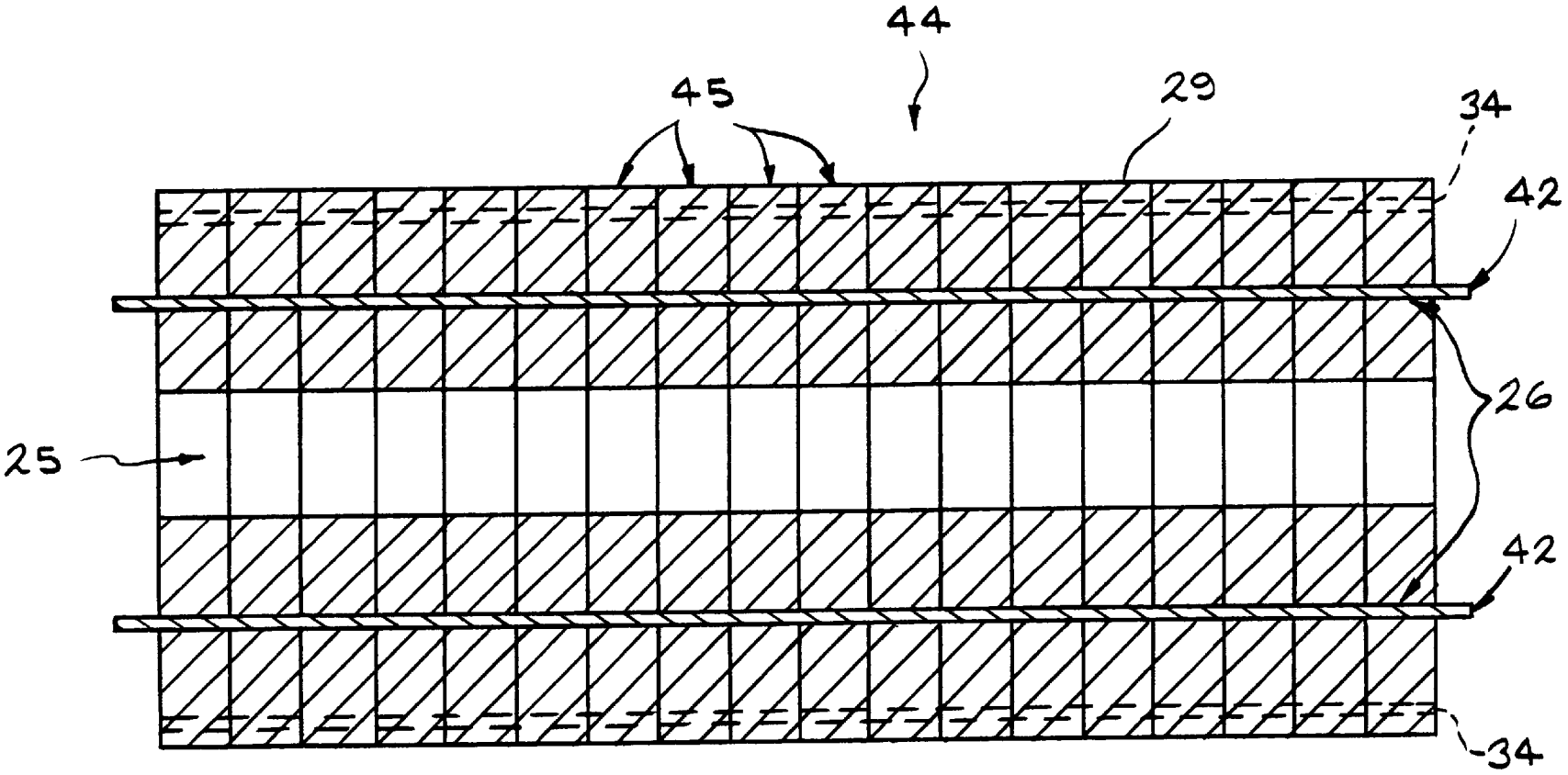
FIG. 7 is a longitudinal-sectional view of the alignment passages taken along line 7—7 of FIG. 6.

FIG. 7 is a cross-section of composite roll 44 of FIG. 6 taken along line 7—7 illustrating two alignment channels with each alignment channel receiving alignment rod 42.

Figure 8:
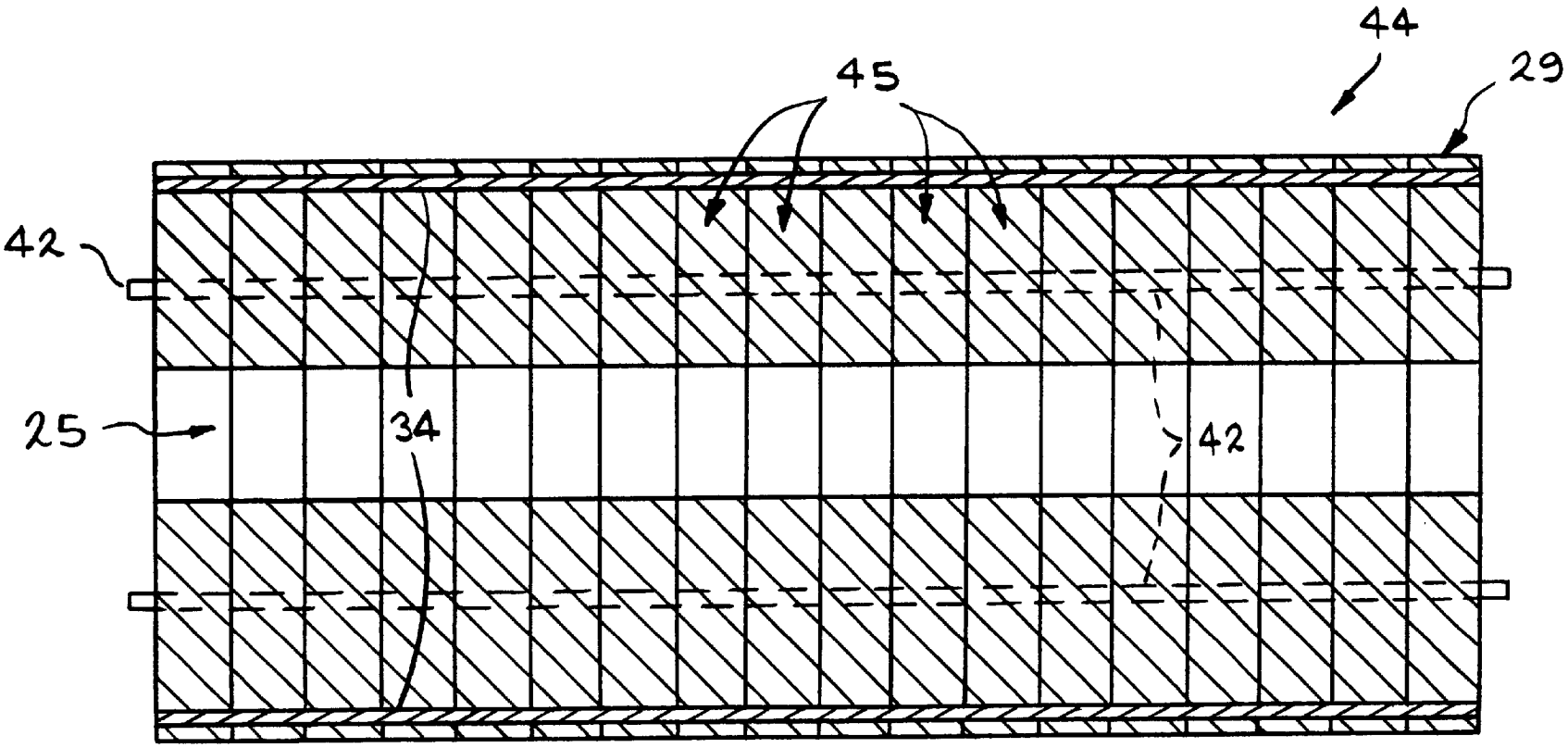
FIG. 8 is a longitudinal-sectional view of the coolant channels taken along line 8—8 of FIG. 6.

FIG. 8 is a cross-section of composite roll 44 of FIG. 6 taken along line 8—8 through coolant channels 34.

Figure 9:
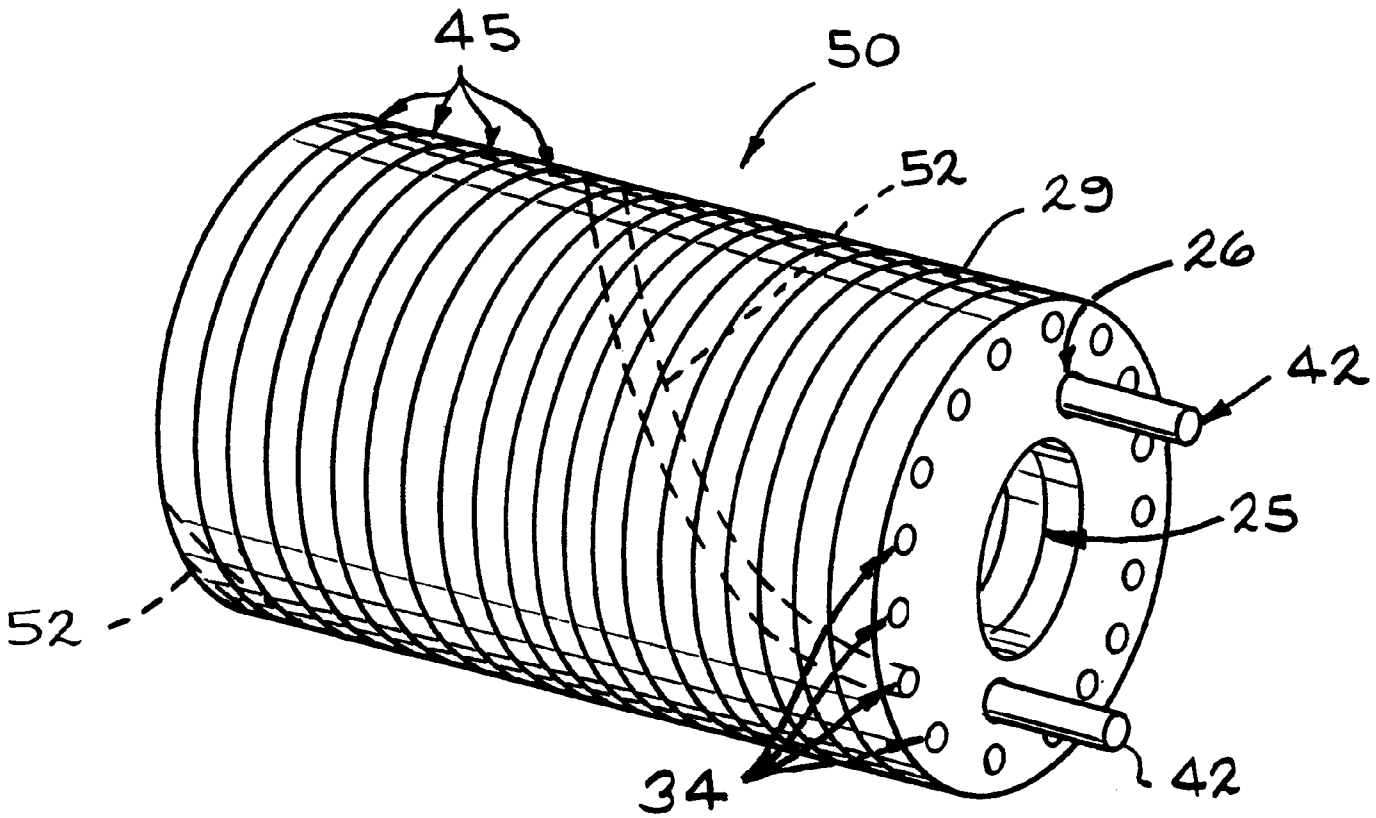
FIG. 9 is a perspective view of another embodiment of a composite casting roll of the invention formed from a plurality of the segments of FIG. 6 where the cooling channels are offset to provide a spiral channel.

FIG. 9 is a partially assembled perspective view of a composite roll 50 illustrating one of the pathways of a spiral coolant channel 52 formed from cooling openings 34 provided within each segment 45 extending across the width of composite roll 50. Even though only a single spiral channel is depicted for simplicity, multiple spiral channels could be used when multiple cooling openings 34 are present in a segment, i.e., seventeen in FIG. 9.

Figure 10:
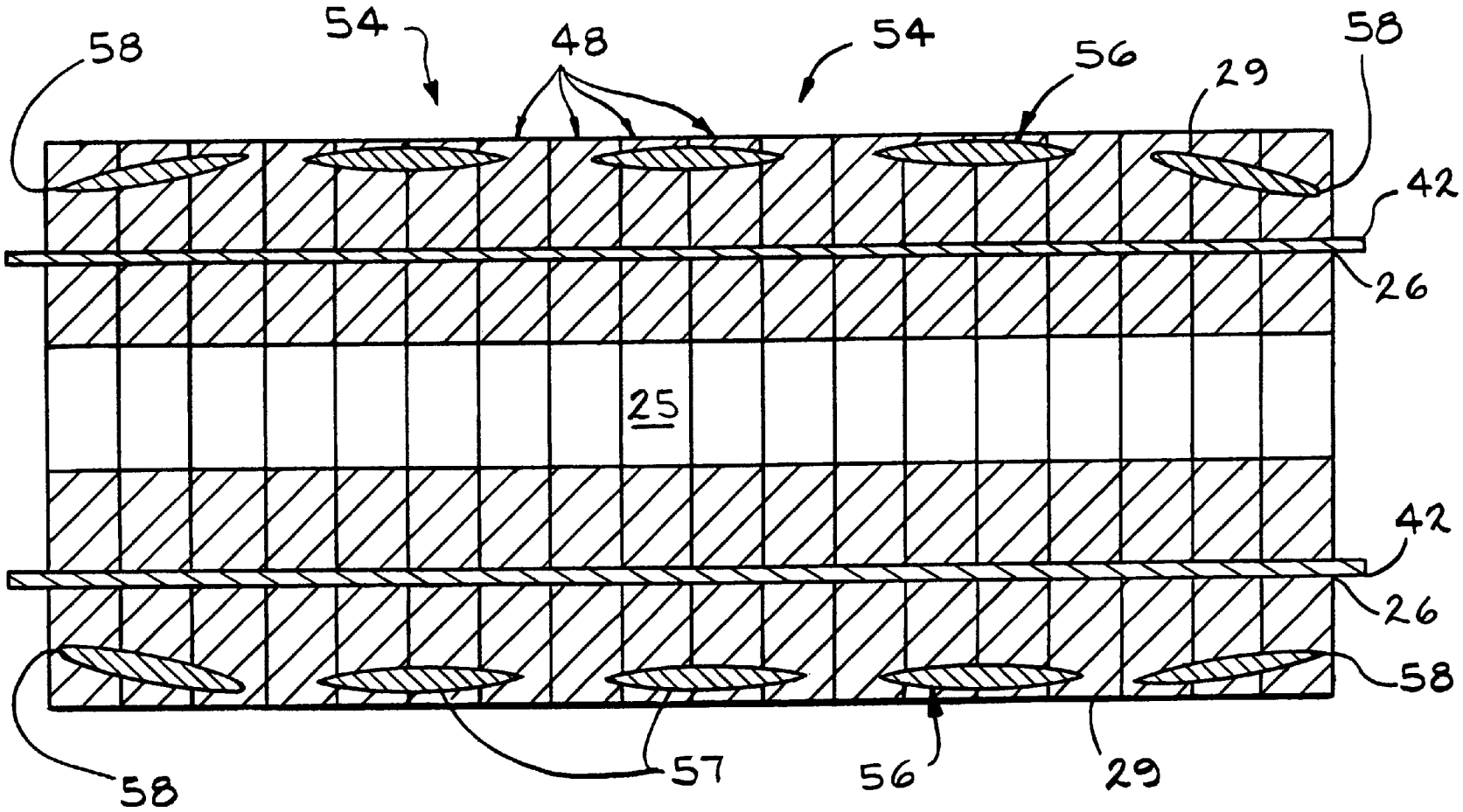
FIG. 10 is a longitudinal-sectional view of the alignment passages and spiral coolant channels of another embodiment illustrating angled coolant channels at the ends of the casting roll for moderation of end cooling effects.

FIG. 10 is a cross-section of a composite roll 54 illustrating a spiral cooling channel 56 formed from coolant openings 57 and 58 exhibiting both end deepening and spiraling. Spiral channel 56 is achieved through the rotation of the alignment openings during stamping of segments 48. When alignment rod 42 is passed through alignment openings 26 during assembly, coolant openings 57 and 58 then become aligned in a spiral pattern. Likewise, the deepened channel at the ends of the casting roll are created by progressively moving the punch for the coolant opening closer to central opening 25 during the punching of each segment 48. The combination of moving the alignment opening and the coolant opening results in both a spiraling and a change of depth of the coolant channel when moving from one segment to the next. Unlike the problem associated with straight bored channels of prior art one-piece casting rolls, a non-linear shaped channel of this invention advantageously improves the overall structural integrity of a casting roll as compared to a straight coolant channel, especially when the casting roll is used with a twin roll caster where roll force is applied during casting of a metal strip. In this embodiment, channels 56 are convoluted shapes. Coolant openings 57 for the inner segments are positioned closer to chill surface 29 than are coolant openings 58 for end segments 48. This convoluted shaped cooling channel allows differential heat transfer from chill surface 29. That is, more heat is removed away from the chill surface in the middle portion of casting roll 54 than from the chill surface toward the end portions of the casting roll. The extent of the spiral, i.e., the amount of rotation per segment, is dependent on segment thickness. The thicker the segment the less rotation that can be achieved without causing extreme disruption to the coolant flow due to rough edges at the transitions between segments.

Figure 11:
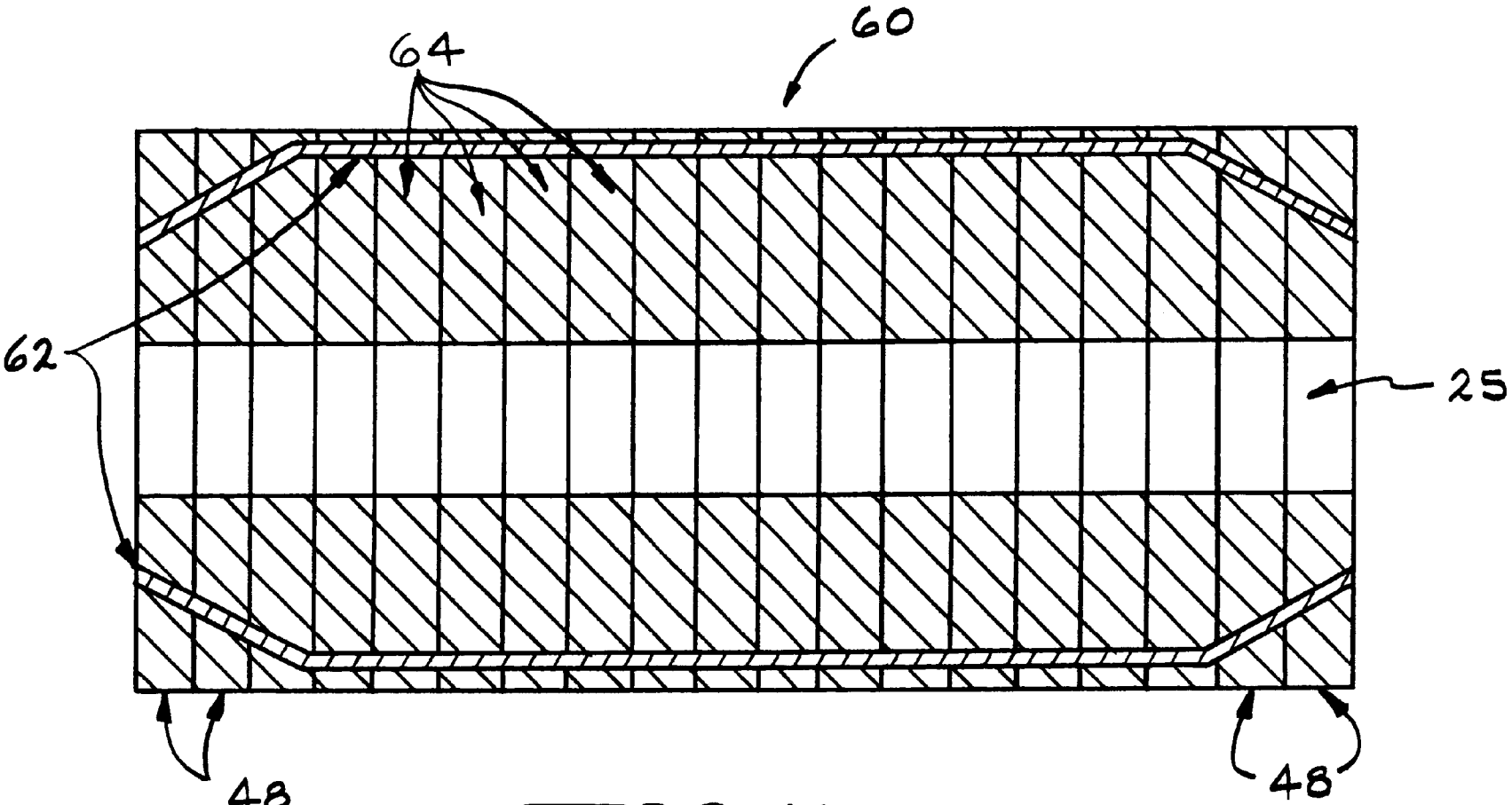
FIG. 11 is a longitudinal-sectional view of another embodiment illustrating coolant channels having angled coolant channels at the ends of the casting roll for moderation of the end cooling effects when the coolant channels are straight.

FIG. 11 is a cross-sectional view of a composite casting roll 60 showing deepening of coolant channels 62 in end segments 48 compared to inner segments 64 in segmented casting roll 60 with a straight coolant channel versus the spiral channel illustrated in FIG. 9.

Figure 12:
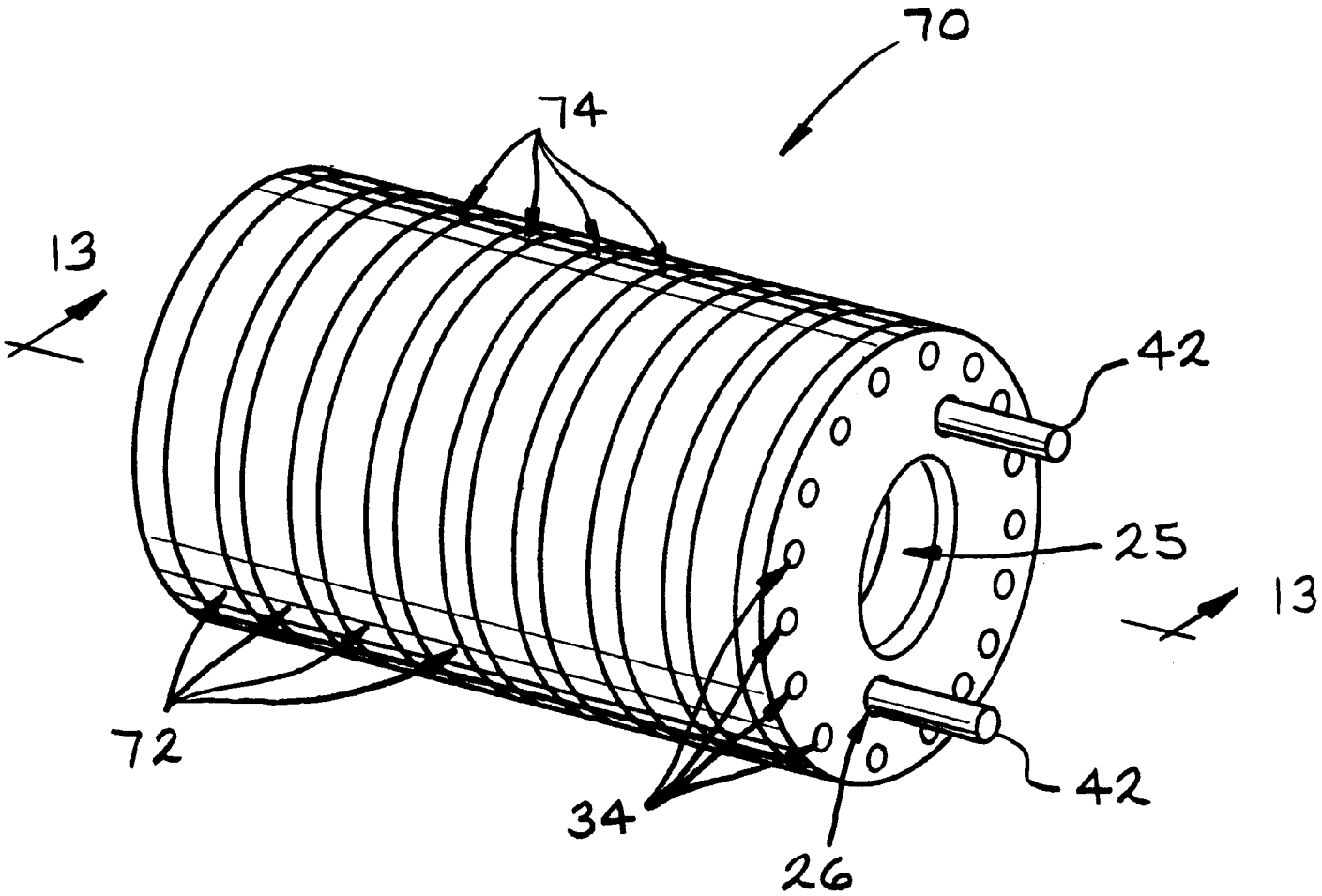
FIG. 12 is a perspective view of another embodiment of a composite casting roll of the invention formed from a plurality of segments of FIG. 2 where the segments are of different thickness and alternating segments are formed of different materials.

FIG. 12 illustrates a partially assembled perspective view of a composite casting roll 70 composed of alternating segments 72 and 74. Segments 72 are of a different material and a different thickness than segments 74. Different materials would not have to be of a different thickness nor would similar materials have to be of the same thickness. All segments 72 and 74 would have coolant openings 34 that would be aligned by means of alignment openings 26 aligned using alignment rods 42.

Figure 13:
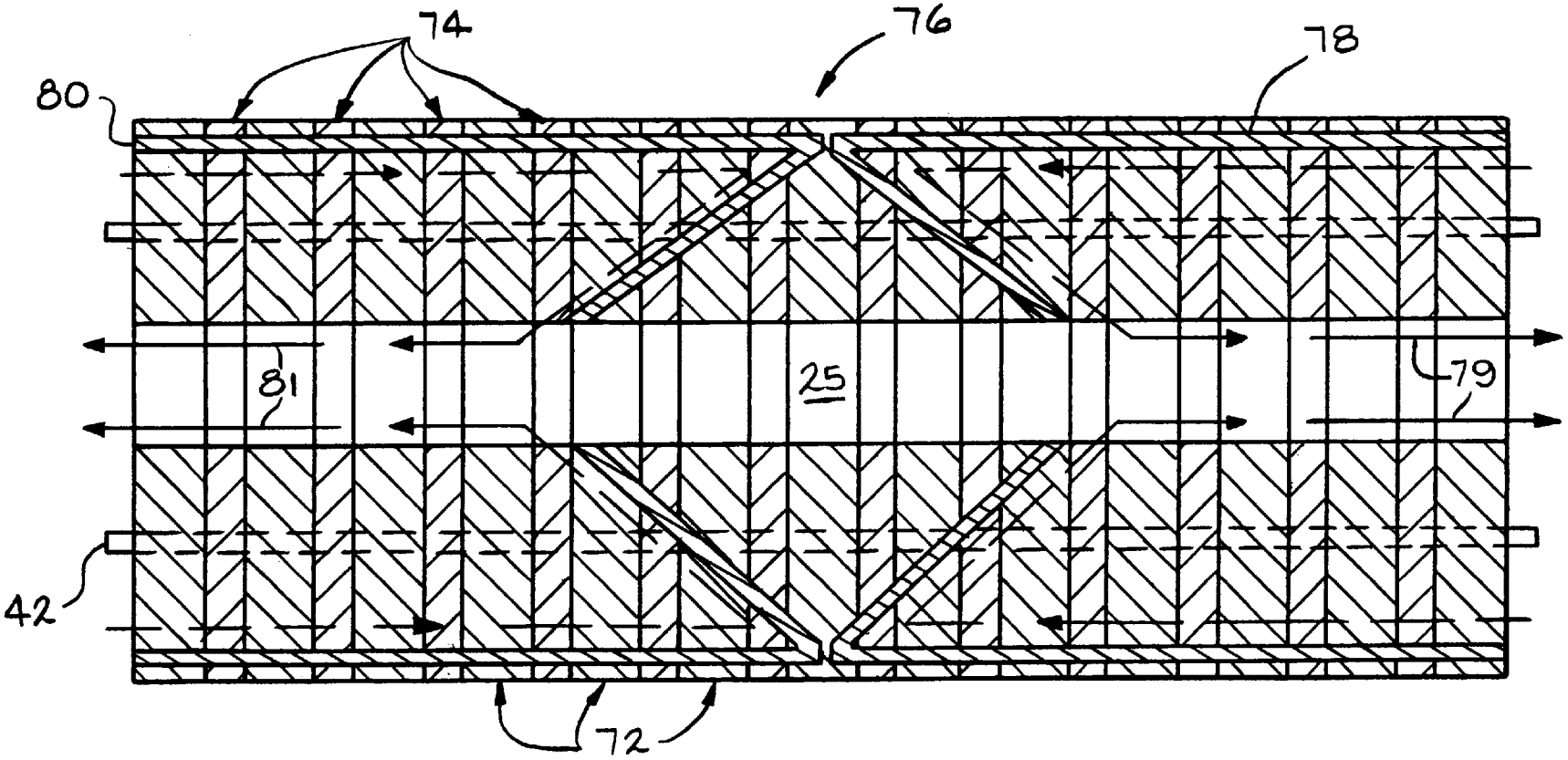
FIG. 13 is a longitudinal-sectional view of another embodiment illustrating coolant channels showing potential for bi-directional coolant flow across large width rolls.

FIG. 13 is a cross-section view of a composite casting roll 76 composed of alternating materials and thicknesses for segments 72 and 74 taken along line 13—13 of FIG. 12 illustrating coolant flow channels 78 and 89 with opposing flow directions 79 and 81 respectively that would be beneficial in large width rolls. This concept can not be duplicated with current technology. While thick segments 72 are alternated with thin segments 74, segments of the same or different materials can be used. If different materials are used, the segments do not have to be evenly spaced and in fact may be present only over a small portion of the width of the roll. Two, three or more materials could be used in the construction of the composite casting roll of this invention.

Figure 14:
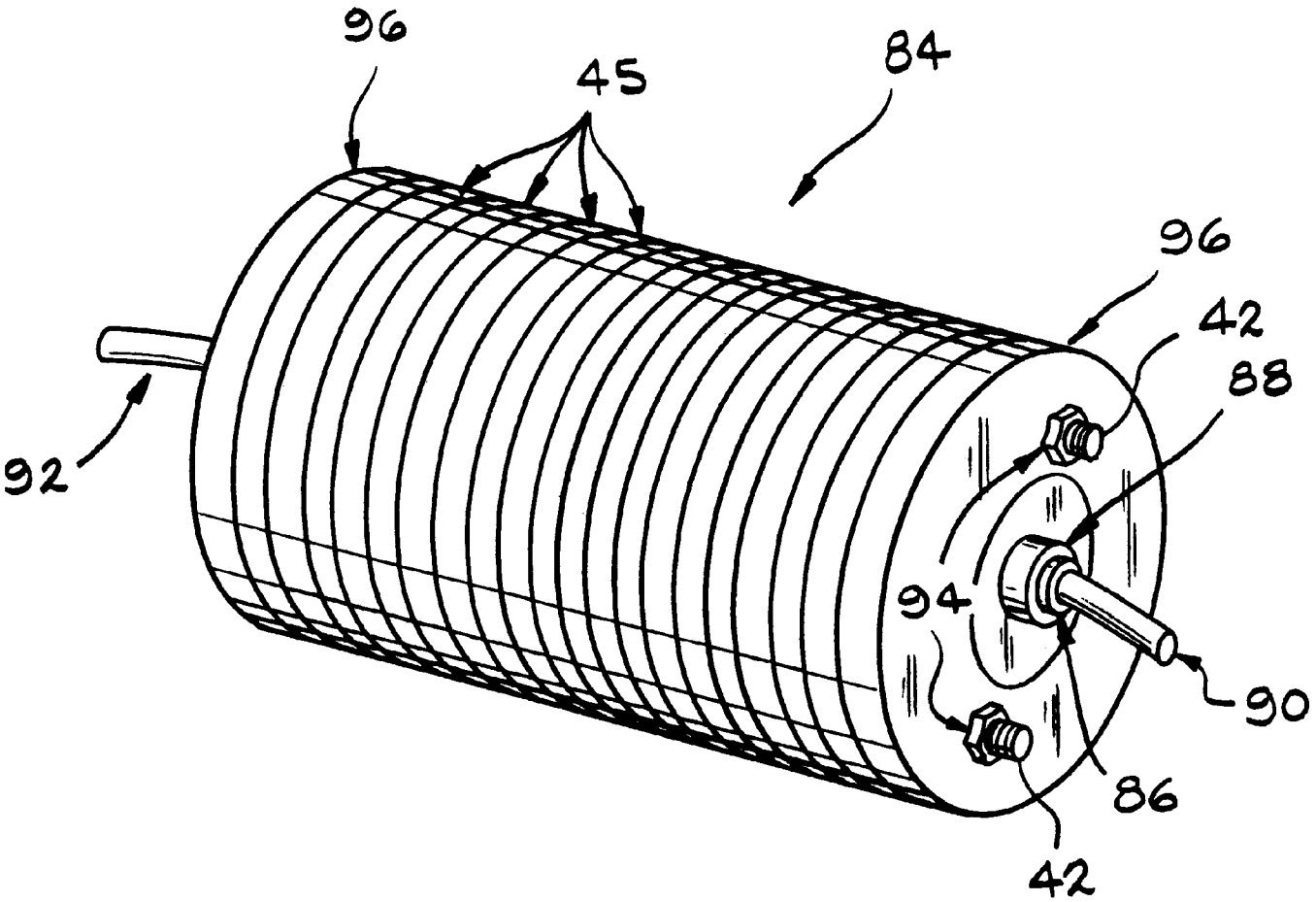
FIG. 14 illustrates a perspective view of an embodiment of a fully assembled composite roll ready for use on a continuous metal strip caster.

FIG. 14 illustrates an embodiment of a composite roll 84 of this invention formed from a plurality of segments 45 axially aligned and structurally connected by a pair of connecting rods 42 extending completely through the width of the composite roll. The roll includes a pair of load supporting spindles 86 with each end of the roll sealed such as by a rotary seal 88. Coolant is supplied to the composite casting roll by a flexible conduit 90 and coolant is removed from the roll through a flexible conduit 92. The segments are structurally connected together by being clamped with the aid of retaining nuts 94 threaded onto alignment rods 42 and bearing against and torqued to the appropriate pressure on an endplate 96 placed on each end of the casting roll.

Figure 15:
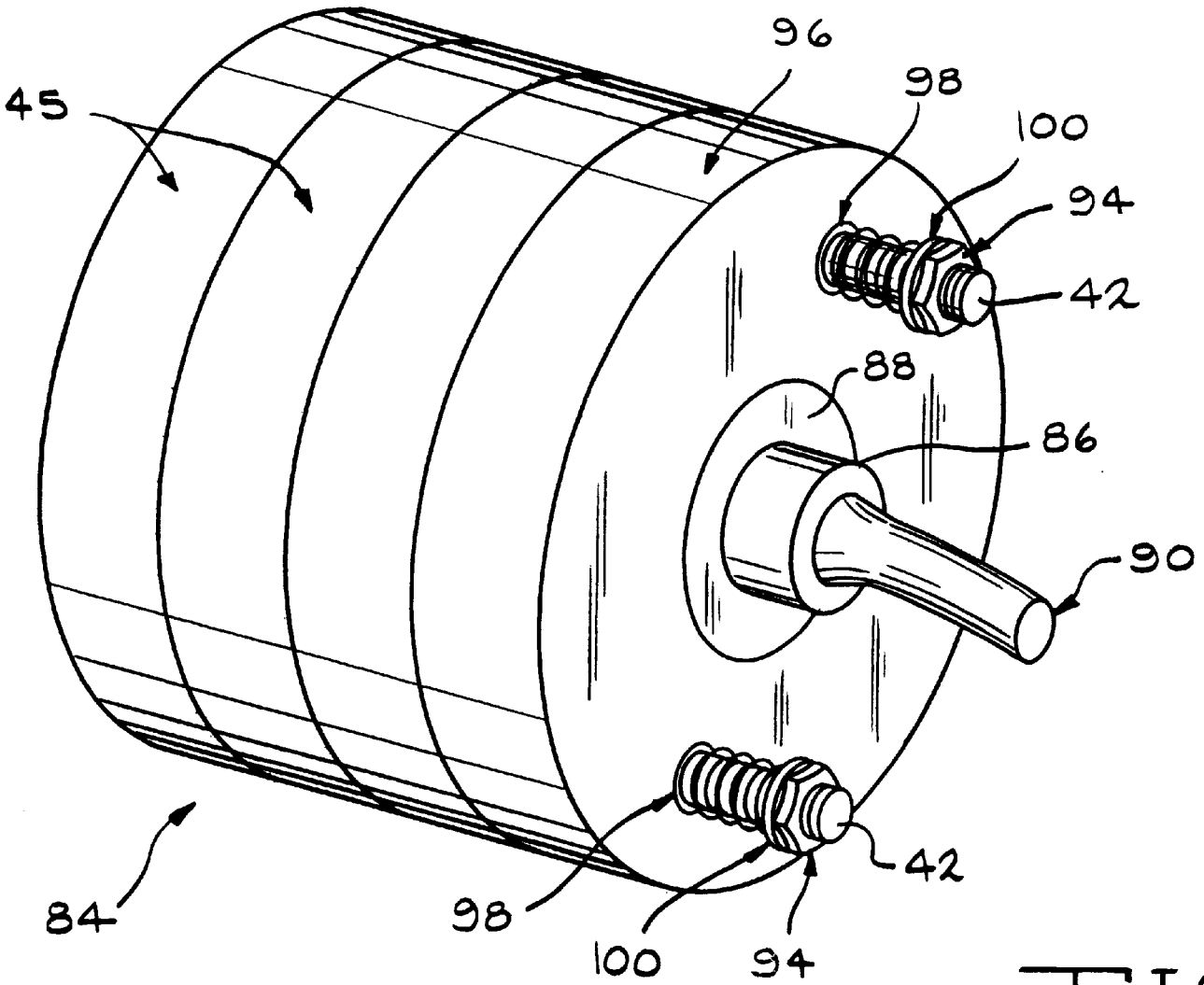
FIG. 15 illustrates a perspective view of an embodiment of a structural connection of the invention for clamping together a composite casting roll.

FIG. 15 illustrates another structural connection wherein each segment 45 is clamped together to form composite casting roll 84 of this invention. The segments are aligned with alignment rod 42 inserted through each of the alignment openings in each roll segment. A spring 98 is placed over each alignment rod 42 followed by a retaining washer or cap 100. A retaining nut 94 then is threaded onto each alignment rod 42 and tightened to the appropriate torque such that the springs bear pressure on endplate 96 sufficient to avoid any coolant leaks. The torque will depend upon materials of construction and coolant pressure. The springs used will depend upon the desired pressure that needs to be maintained between segments. Pressure within composite roll 84 that typically builds up do to thermal expansion during casting will result in lateral movement of the roll segments 45 along alignment rods 42 and against springs 98 and endplates 96, which will keep constant pressure between casting roll segments 45. This will result in lower distortion of the roll shape, more uniform control over strip shape, and ease in roll maintenance as well as in casting roll width changes. A similar arrangement using hydraulics instead of springs would also be possible. The clamping means of this embodiment enables lower distortion of the roll shape due to thermal expansion.

Another advantage of the clamping mechanisms of FIGS. 14 or 15 of this invention is that damaged segments may easily be removed from the casting roll and replaced. A further advantage is being able to change the casting roll width without having to maintain a large inventory of casting roll sizes.

EXAMPLE

By way of an example, a composite casting roll of this invention will now be described. Segments having an outer diameter of 1000 mm and a central opening diameter of 800 mm could be stamped from a metal sheet having a thickness of 1.5 mm, a width of 1010 mm and a base composition of 0.1% Fe, 0.1% Si, 1% Cr and the balance essentially copper. Each segment could be provided with 276 cooling openings having a diameter of 5 mm and 8 alignment openings having a diameter of 12 mm. The cooling openings would be evenly spaced into an annular array positioned 12 mm from the outer chill surface of each segment. The alignment openings also would be evenly spaced into an array positioned 50 mm from the outer chill surface of each segment, i.e., 40.5 mm inside the cooling opening array. One thousand three hundred thirty four (1334) of these segments could be stacked together forming a composite casting roll having a width of 2001 mm and a diameter of 1000 mm. The segments could be structurally connected together by passing a metal rod having a length of at least 2076 mm through all the alignment openings of all the segments and end plates and bolting both ends of the each of the alignment rods. The connected segments could be mounted onto a mandrel having a diameter of 800 mm. Thereafter, each end of the composite casting roll would be provided with a rotary seal.

It will be understood various modifications may be made to the invention without departing from the spirit and scope of it. Therefore, the limits of the invention should be determined from the appended claims.

What is claimed is:

1. A continuous casting roller for casting continuous metal strip, comprising:

a plurality of annular heat resistant segments having a common diameter, each segment including at least one opening extending through the axial thickness, the segments structurally connected together with the openings of the segments aligned with one another forming a channel for circulating a cooling fluid therethrough at a distance of at least 5 mm beneath a chill surface of the roll to enable a cooling effect on the chill surface and provide structural soundness of the heat resistant segments.

2. The casting roll of claim 1 wherein each segment includes a plurality of the coolant openings.

3. The casting roll of claim 2 wherein the openings of each segment are evenly spaced and positioned into an annular array.

4. The casting roll of claim 3 wherein each segment includes means for aligning adjacent segments.

5. The casting roll of claim 4 wherein the alignment means includes each segment having an alignment opening extending through the axial thickness and positioned inside the array.

6. The casting roll of claim 5 wherein the alignment means further includes a support rod extending through the alignment openings.

7. The casting roll of claim 1 wherein the cooling openings are misaligned so that the cooling channel forms a spiral or serpentine shape along the width of the roll.

8. The casting roll of claim 1 wherein each cooling channel is convoluted.

9. The casting roll of claim 1 wherein the chill surface of each segment is roughened.

10. The casting roll of claim 9 wherein the chill surface of adjacent segments has a different roughened surface.

11. The casting roll of claim 1 wherein adjacent segments have a different axial thickness.

12. The casting roll of claim 1 wherein adjacent segments are of a different composition.

13. The casting roll of claim 12 wherein segments are of different axial thickness.

14. The casting roll of claim 1 wherein the planar surfaces between the segments are coated with a coating.

15. The casting roll of claim 14 wherein the coating is insulative.

16. The casting roll of claim 4 wherein each segment includes means for aligning the openings.

17. The casting roll of claim 5 wherein the segments are held in place by a clamping mechanism.

18. The casting roll of claim 17 wherein the clamping mechanism includes an alignment rod and a pair of endplates.

19. The casting roll of claim 1 wherein the segments are removable for changing the width of the roll.

20. The casting roll of claim 1 wherein the structural connection allows for control of the distortion of the casting roll due to thermal expansion.

21. The casting roll of claim 1 wherein the geometry of the coolant openings is a circle.

22. The casting roll of claim 1 wherein the segments are metal.

23. A continuous casting roller for casting continuous metal strip, comprising:

a plurality of annular heat resistant segments having a common diameter, each segment including a plurality of openings extending through the axial thickness, the openings evenly spaced and formed into an annular array, the segments structurally connected together with the openings of the segments aligned with one another to form channels for circulating a cooling fluid therethrough at a distance of at least 5 mm beneath a chill surface of the roll to enable a cooling effect on the chill surface and provide structural soundness of each heat resistant segment.

24. A continuous casting roller for casting continuous metal strip, comprising:

a plurality of annular heat resistant segments having a common diameter, each segment including a plurality of coolant openings and at least one alignment opening, the openings extending through the axial thickness of the segments, the coolant openings evenly spaced and formed into an annular array, the segments structurally connected together with the coolant openings of the segments aligned with one another to form channels for circulating a cooling fluid therethrough at a distance of at least 5 mm beneath a chill surface of the roll to enable a cooling effect on the chill surface and provide structural soundness of each heat resistant segment.

* * * * *